US005918326A

United States Patent [19]

Takagi et al.

[11] Patent Number: 5,918,326

[45] Date of Patent: Jul. 6, 1999

[54] WATER JET MASSAGING SYSTEM

[75] Inventors: Kazumi Takagi; Michihiro Shimizu; Kenji Takagi; Kenichi Ito; Masaru Mochizuki, all of Fuji, Japan

[73] Assignee: Takagi Industrial Co., Ltd., Fuji, Japan

[21] Appl. No.: 09/009,884

[22] Filed: Jan. 21, 1998

[30] Foreign Application Priority Data

Feb. 14, 1997 [JP] Japan ..... 9-030317

[51] Int. Cl.[6] ..... A61H 33/02

[52] U.S. Cl. ..... 4/541.3; 4/541.6

[58] Field of Search ..... 4/541.3, 541.4, 4/541.6, 559

[56] References Cited

U.S. PATENT DOCUMENTS 3,286,712 11/1966 Roden ..... 4/541.4 X 5,058,220 10/1991 Mikiya ..... 4/541.4

5,197,153 3/1993 Hara ..... 4/541.4

*Primary Examiner*—Robert M. Fetsuga

*Attorney, Agent, or Firm*—Pollock, Vande Sande & Amernick

[57] ABSTRACT

A water jet massaging system is capable of applying water jet massage while a bather is taking a bath by producing a water jet at an appropriate pressure, and having enhanced operability by preventing sticking of a water intake and a nozzle to the body of the bather. More specifically, water is sucked in from a water source by a pump, and water jet at an appropriate pressure is injected through a nozzle so as to beat at the surface of the body of the bather, attaining massaging effects of water jet with ease. Further, the water intake is provided with passages for water flow to prevent blockage of water flow, and the nozzle is provided with an inclined surface on the side opposite the body to slow down velocity of water flow, preventing a sticking phenomenon.

15 Claims, 11 Drawing Sheets

WATER JET MASSAGING SYSTEM

BACKGROUND OF THE INVENTION

1. Field of the Invention

The invention relates to a water jet massaging system for applying water jet massage to parts of a human body taking advantage of pressure, impact, friction, and the like of water jet.

2. Description of the Related Art

Kinetic massage similar to that given by finger-pressure therapy can be applied to the body of a person taking bath, taking advantage of localized pressurization of, or impact to the body caused by a pressure of water jet, or friction occurring between the water jet and the skin of the body when the water jet at an appropriate pressure is caused to beat at the surface of the skin. This type of treatment can provide massaging effects which such a static treatment as is given by the finger-pressure therapy is not expected to provide. It is well known that massaging given in a hot bath utilizing hot water jet is effective in refreshing the body, coupled with beneficial effects of taking a dip in the hot bath, and by injecting water jet, immeasurably beneficial effects are expected. This type of massaging systems have been disclosed in Japanese Utility Model Registration No. 2502192 under the title "Beauty Promotion System in Bath", Japanese Patent Laid-open H 1-178028 "Liquid Jet Type Massaging System", and so on.

However, there have been very few massaging systems utilizing water jet which can be put to use at home with ease because of such problems as needs for installing an elaborate apparatus for generating high pressure water jet for use in a bathtub at home, inconvenience in handling, and the like.

There has been another problem that when water is sucked into a system via an intake dipped in a bath, the intake sometimes sticks to the body or the inner walls of a bathtub. Normally, hot water is sucked in through the intake composed of a flexible pipe, and when a pressure for injecting hot water is increased, a force for sucking the hot water from the bathtub also increases, increasing a risk of the intake sticking to the body or the sidewalls of the bathtub. In the event of the intake sticking to the body, this will not only give the user discomfort, but also block suction of the hot water, resulting in stoppage of water flow. In such a case, operation of a pump unit needs to be stopped in order to remove the intake from the body or the like.

There has been yet another problem with the system that when a water jet at an appropriate pressure is produced to enhance massaging effects, sticking of a nozzle to the body occurs. FIG. 11 shows a condition in which water jet W from a nozzle 202 beats at the skin 200 of a body. When the skin 200 is at some distance from the end face of the nozzle 202, the water jet W causes a recess 204 to be formed on the surface of the skin 200, and simultaneously, bounces back from the skin 200 in radial directions. On the other hand, when the nozzle 202 comes closer to the skin 200 as shown in FIG. 12, exit areas 206 for the water jet W are narrowed down while a pressure at work on the surface of the skin 200 increases. As a result, a flow velocity increases dramatically. Due to such relationship between the velocity of the water jet W and the pressure as described above, an abnormal phenomenon of the end face of the nozzle 202 sticking to the skin 200 occurs, causing discomfort on the part of the user. The higher the pressure of discharge from the nozzle 202 is, the more pronounced such a phenomenon of the nozzle 202 sticking to the skin becomes.

SUMMARY OF THE INVENTION

It is therefore an object of the invention to provide a water jet massaging system capable of applying water jet massage while a bather is taking a bath by producing a water jet at an appropriate pressure, and causing the water jet to beat at the body of the bather.

A further object of the invention is to provide a water jet massaging system having enhanced operability by preventing sticking of a water intake and a nozzle to the body of the bather.

More specifically, as shown in FIGS. 1 to 10 by way of example, with the water jet massaging system according to the invention, water is sucked in from a water supply source (bathtub 2) by a pump (10), and water jet (W) at an appropriate pressure is injected through a nozzle (14) so as to beat at the surface of the body of the bather, attaining massaging effects of water jet with ease.

Also, with the water jet massaging system according to the invention, as shown in FIGS. 1 to 10 by way of example, the water intake (8) is provided with a water passage device (skirt 62 and through-holes 78) for ensuring prevention of stoppage of water flow, and the nozzle (14) has a tilted surface on the side facing the body for moderating the velocity of the water jet so that a sticking phenomenon is prevented. The water jet massaging system according to the invention for applying massage to the body by injection of hot water comprises means for generating a water jet (water jet generating unit 4) provided with a water source (bathtub 2) for supplying the hot water, a pump (10) for sucking in the hot water from the water source through a water intake (8), a nozzle (14) linked with the means a for generating water jet via a water supply pipe, and through which water jet (W) is injected, a switch (startup switch 18) for turning operation of the pump on and off, and a controller for turning operation of the pump on and off by manipulation of the switch so that the hot water sucked in from the water source is injected to the surface of the body through the nozzle. With the system constructed as above, massaging by water jet can be performed with ease by manipulating the switch so as to cause appropriate a water jet to beat at the body while a bather is taking a bath.

In operation, hot water in a bathtub or tap water can be used as the water source. In the case of tap water heated in a hot water supply unit, sufficient pressurization is achieved by sucking in with the use of the pump.

The water intake is provided with a partition wall (skirt 62) for partitioning an area on which a suction pressure is at work, water passages (the skirt 62 and through-holes 78) are formed on the partition wall, and through the water passages, hot water from the water source is sucked into the system. The construction described above enables prevention of the water intake sticking to the inner walls of the bathtub or the body of a bather, forestalling troubles such as stoppage of water flow.

The nozzle is characterized by a tapered surface formed on the front end side thereof such that an interval between the nozzle and the body is widened in the radial direction. Even when the nozzle constructed as above is brought closer to the body, sticking of the nozzle to the body can be prevented so that a user can apply a desired water pressure to his body by bringing the nozzle closer to the skin.

The switch is installed on the side wall of the nozzle, and a signal line (cable 22) from the switch is embedded in the water supply pipe for connection with the controller. Accordingly, the user is able to switch over operation of the system by one hand while taking a bath, and simultaneously to manipulate positioning of the nozzle with the result that operability of the system is enhanced.

Further, the controller is capable of stopping operation of the pump after the elapse of predetermined time from the start of the operation by summation of respective operation time based on manipulation of the switch so that overheating of the pump and excessive massaging over many hours can be prevented.

Furthermore, with respect to the nozzle, the tapered surface has varied tile angles partially in order to ensure prevention of sticking of the nozzle to the body.

Other objects, features, and advantages of the invention will become apparent from the following description of embodiments and examples with reference to the accompanying drawings.

DETAILED DESCRIPTION OF THE PREFERRED EMBODIMENTS

Figure 1:
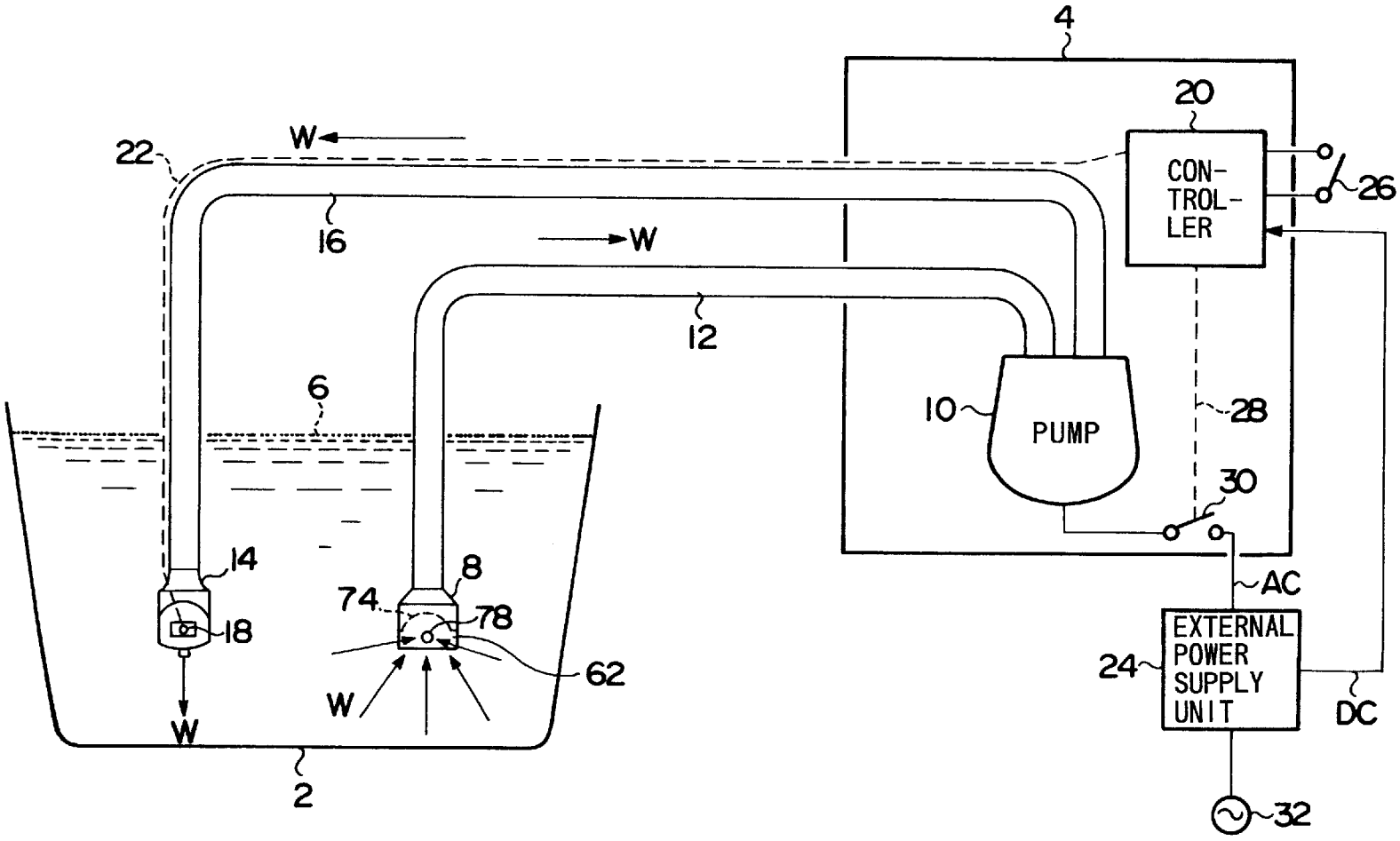
FIG. 1 is a view illustrating an embodiment of a water jet massaging system according to the invention.

The invention is described in detail hereinafter with reference to embodiments thereof shown in the drawings. FIG. 1 is a view illustrating an embodiment of a water jet massaging system according to the invention. In the embodiment, hot water contained in a bathtub 2 is used as a water source, however, tap water from water service or the like may be used as well. A water jet generation unit 4 is installed in an area adjacent to the bathtub 2. The water jet generation unit 4 makes up means for delivering a water jet whereby hot water 6 is sucked in from the bathtub 2, and returned under an appropriate pressure to the bathtub 2. The arrow denoted by W indicates the direction of water flow. A water intake 8 is disposed in the bathtub 2, and linked via a water suction pipe 12 with a pump 10 of the water jet generation unit 4. The water suction pipe 12 is a flexible pipe formed of elastic synthetic resin, and the like. A nozzle 14 is linked with the pump 10 via a water supply pipe 16. The water supply pipe 16 is also a flexible pipe formed of elastic synthetic resin, and the like, in which a cable 22, that is, a signal line for electrically connecting a startup switch 18 installed in the nozzle 14 with a controller 20 of the water jet generation unit 4.

The controller 20 is a means for controlling driving of the pump 10. Power is supplied to the controller 20 from an external power supply unit 24, and supply of power is turned on or off by an operation switch 26. The pump 10 is connected to the external power supply unit 24 via a relay contact 30 of a relay 28, and opening/closing of the relay contact 30 is controlled by the controller 20.

The external power supply unit 24 is installed outside a bath room, separately from the water jet generation unit 4, and connected to a commercial AC power source 32.

For operation of the water jet massaging system described above, power is supplied to the external power supply unit 24, and the operation switch 26 of the water generation unit 4 is turned ON. Then, a user can generate water jet W, and cause the same to beat at desired spots of the body by holding the nozzle 14 in one hand and manipulating the startup switch 18 after dipping the water intake 8 and the nozzle 14 in the hot water 6 in the bathtub 2. As a result, massaging effects are obtained by applying hot water or cold water, and pressurization of water flow.

Figure 2:
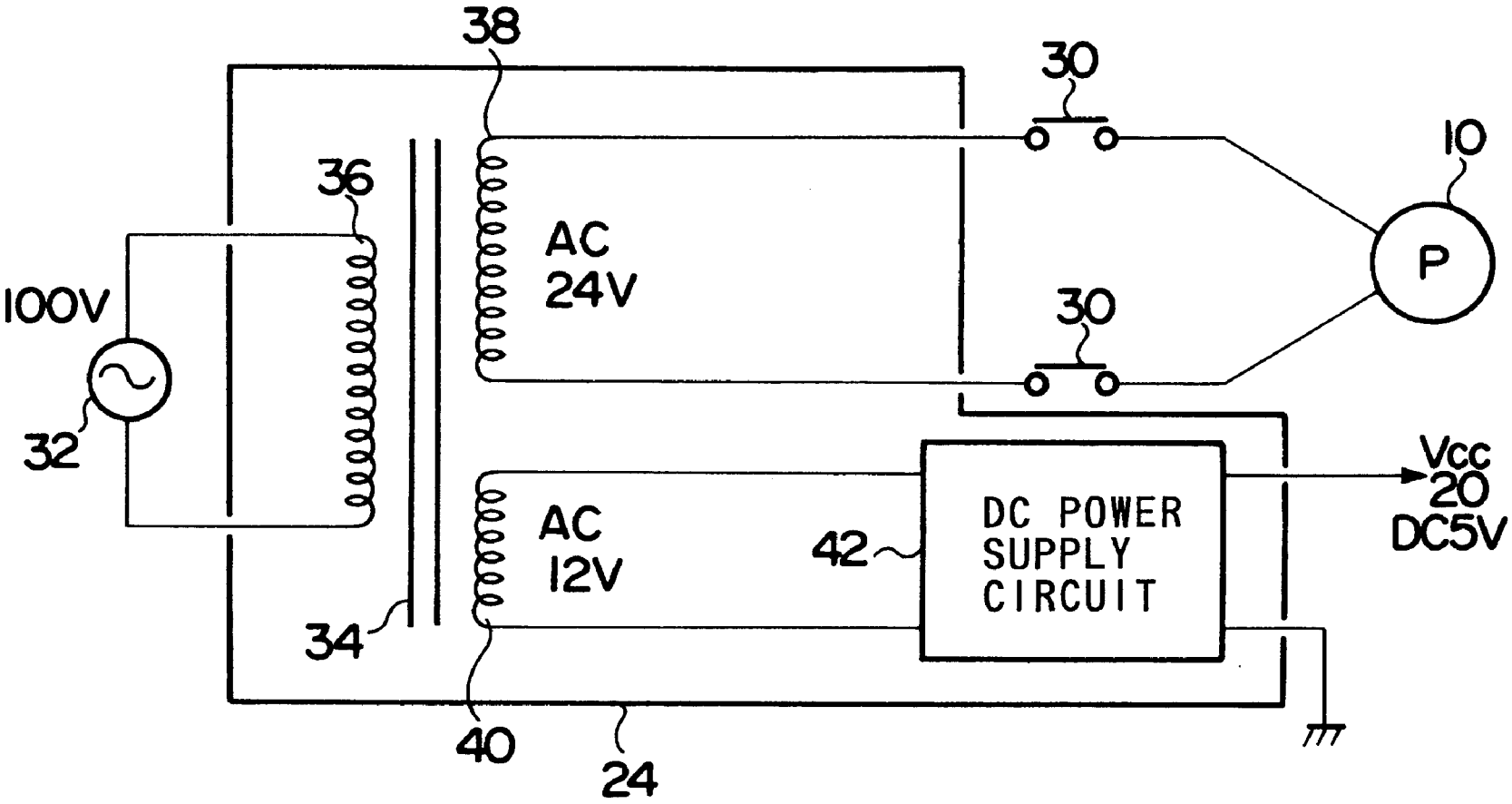
FIG. 2 is a block diagram of an external power supply unit of the embodiment of the water jet massaging system according to the invention.

FIG. 2 illustrates an embodiment of the external power supply unit 24 of the system according to the invention. The external power supply unit 24 is installed separately to enhance safety by insulating the bath room from the AC power source 32 and providing a low voltage power source inside the bath room. The external power supply unit 24 is provided with a transformer 34, a primary coil 36 connected to the AC power source 32. The transformer 34 is provided with two secondary coils 38 and 40. A low voltage AC is outputted from the secondary coil 38, and supplied to the pump 10 via two relay contacts 30. The other secondary coil 40 is connected to a DC power supply circuit 42 for outputting DC to the controller 20.

Figure 3:
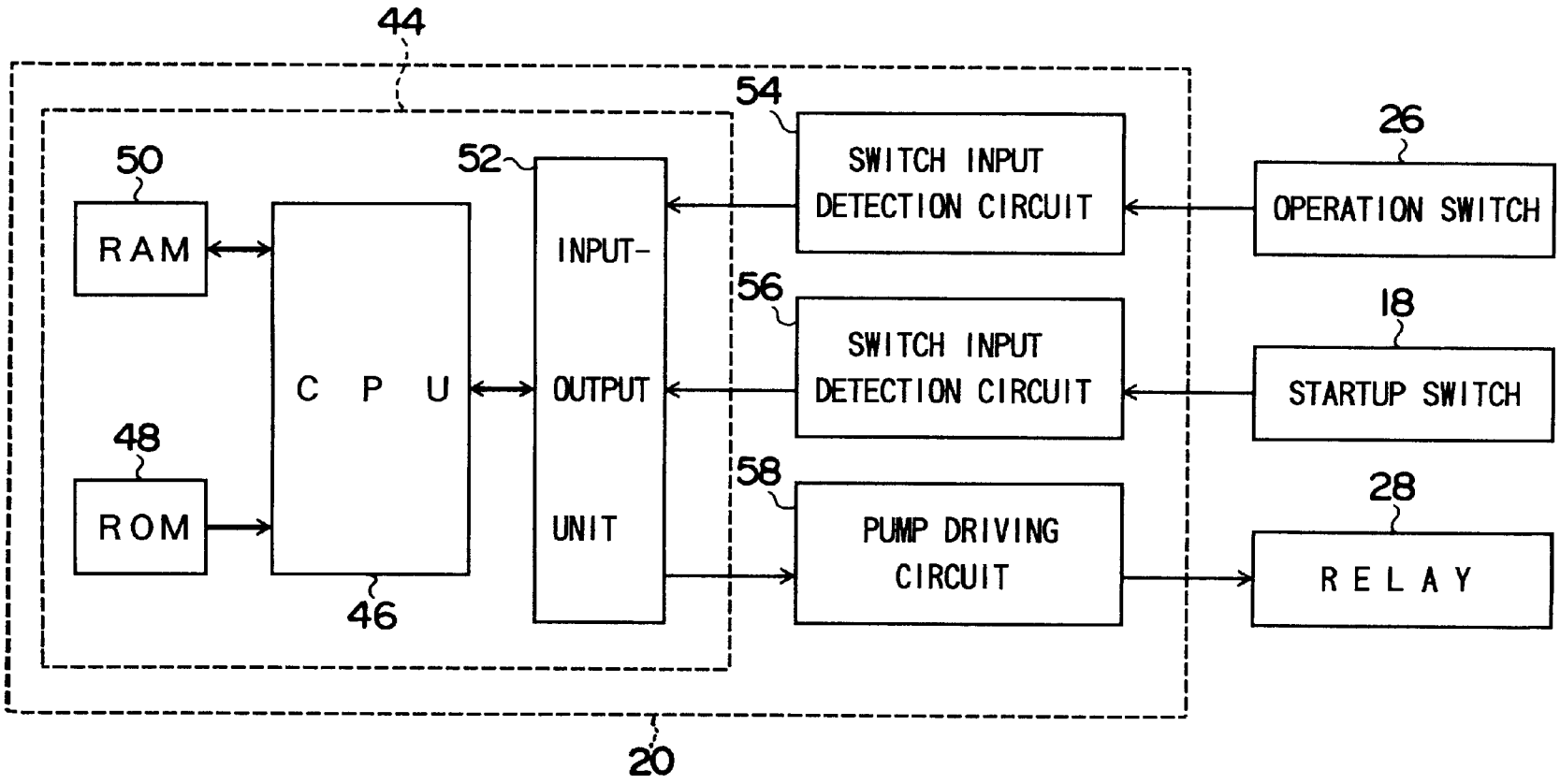
FIG. 3 is a block diagram of a controller of the embodiment.

FIG. 3 is a block diagram showing the construction of the controller 20. The controller 20 is provided with a microcomputer 44 comprising a CPU 46 as means for computing, a ROM 48 and a RAM 50 as means for storing information, and an input-output unit 52. Signals for ON or OFF from the operation switch 26 are delivered to the input-output unit 52 via a switch input detection circuit 54. Signals for ON or OFF from the startup switch 18 are also delivered to the input-output unit 52 via another switch input detection circuit 56. Then, in controlling supply of power to the pump 10, control signals from the input-output unit 52 are delivered to a pump driving circuit 58, output from which controls excitation of the relay 28 of a solenoid, opening or closing the two relay contacts 30.

The controller 20 controls detection of manipulation of the switches, and operation of the pump 10. The controller 20 shifts to an operation standby mode when detecting an input for operation from the operation switch 26 for a predetermined length of time continuously. Then, unless the user keeps pressing the operation switch 26, the input is not taken as a signal for starting operation, thus preventing generation of water jet even if the startup switch 18 is activated inadvertently. In this way, safety is enhanced. In the operation standby mode, generation of a water jet can be completed by manipulation of the startup switch 18. Every time an input by the startup switch 18 of the nozzle 14 is detected after shifting to the operation standby mode, the relay 28 is activated, driving or stopping the pump 10. A bather can hold the nozzle 14 in one hand while turning ON the startup switch 18. For example, a momentary switch as means for avoiding a constant ON-condition may be used for the operation switch 26 and the startup switch 18. When activation of the operation switch 26 is detected, the operation standby mode is released, and the controller returns to OFF-condition. When the controller shifts to an operation mode after detecting activation of the startup switch 18, and then after the elapse of a predetermined length of time, both the operation mode and operation standby mode are released, turning the pump 10 to OFF-condition.

The controller 20 performs computation of lengths of operation time of the pump 10 on the basis of manipulation of the startup switch 18, and when the aggregate length of the operation time reaches a predetermined length of time, excitation of the relay 28 is released, stopping operation of the pump 10. As operation times are thus restricted, extreme prolongation of time for massaging by the bather can be prevented. Furthermore, unnecessary driving of the pump 10 can be prevented, troubles such as idle running of the pump is avoided.

A predetermined DC voltage is always supplied from the external power supply unit 24 to the controller 20, the CPU 46 monitors, by sampling via the switch input detection circuits 54, 56, whether or not there has been any input in the operation switch 26 and the startup switch 18. When an input in the operation switch 26 is detected, the CPU 46 sets the flag, stores information in the RAM 50, and monitors by sampling whether or not detection has been made for a predetermined length of time continuously. After detection of the predetermined length of time, the controller 20 shifts to the operation standby mode. Upon detection of an input in the startup switch 18, the pump driving circuit 58 is activated, exciting the relay 28, closing the relay contacts 30, applying a driving voltage for driving the pump 10, and generating water jet W. Unless a new input in the startup switch 18 is detected after lapse of a predetermined length of time that the pump 10 has been driven by the CPU 46, the pump 10 is caused to stop while the system is shifted to an OFF condition.

Figure 4:
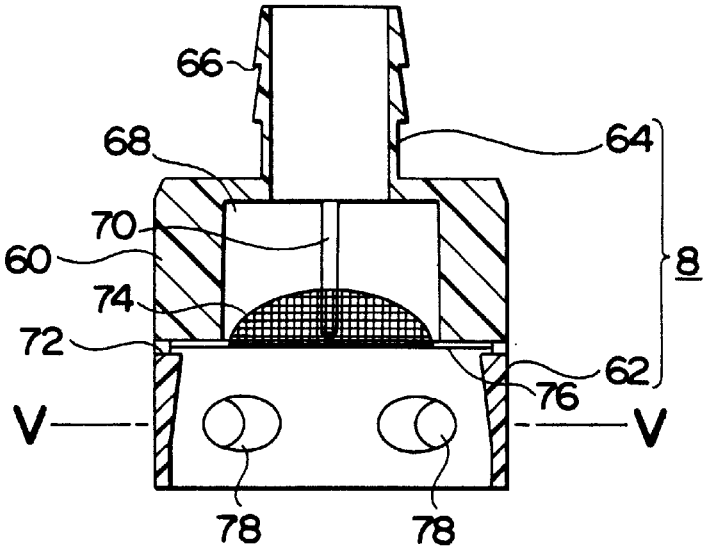
FIG. 4 is a longitudinal sectional view of a water intake of the embodiment.
Figure 5:
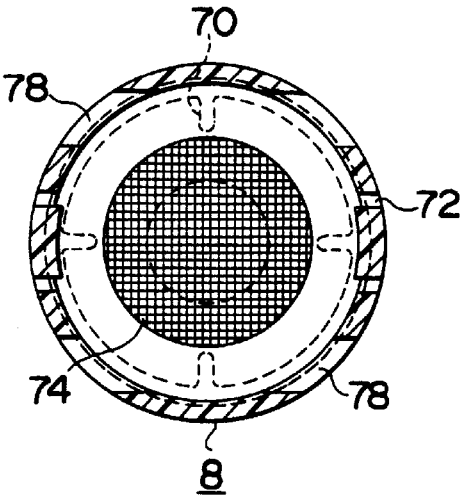
FIG. 5 is a transverse cross section of the water intake taken on line V—V in FIG. 4.
Figure 6:
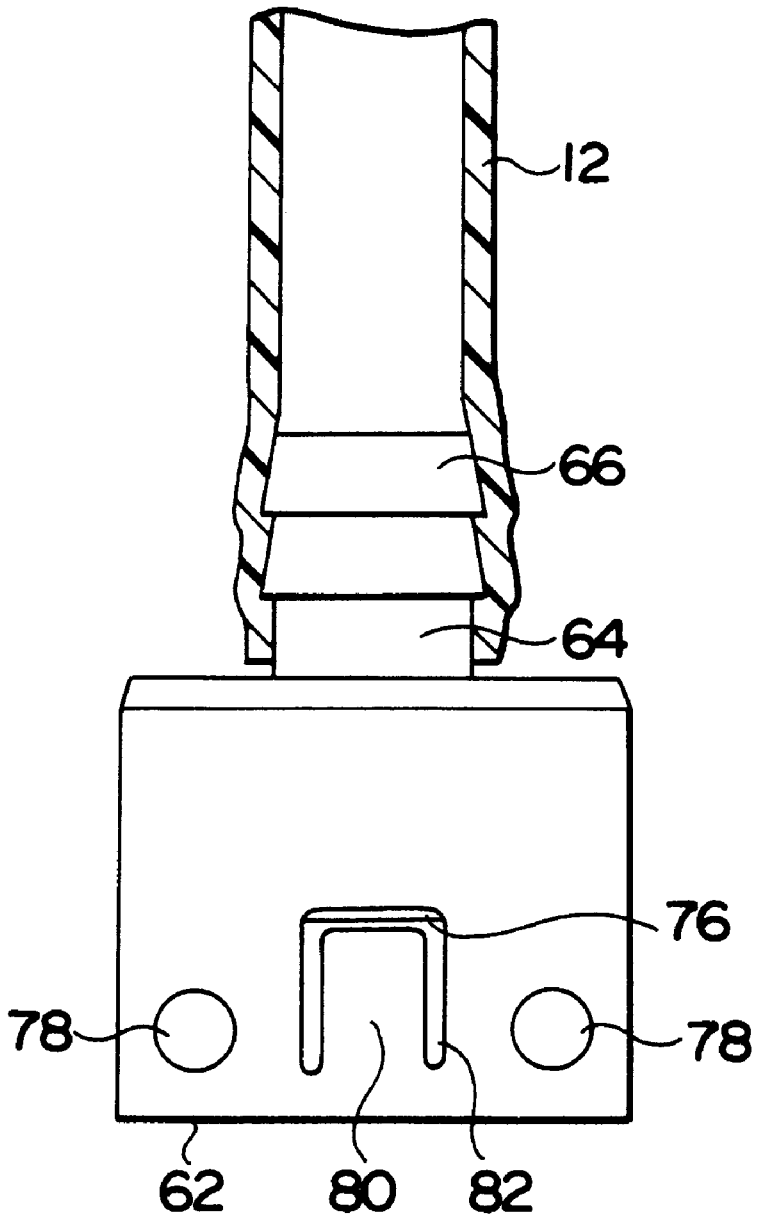
FIG. 6 is a side view of the water intake.

FIGS. 4 to 6 show the construction of the water intake 8. FIG. 4 is a vertical sectional view of the water intake 8, FIG. 5 a transverse cross section thereof taken on line V—V in FIG. 4, and FIG. 6 a view showing the water suction side of the water intake 8.

The water intake 8 comprises a main body 60, a skirt 62, and a coupling 64. The skirt 62 is an embodiment of a partition wall for partitioning a suction pressure at work on the main body 60 from the external side. The main body 60, the skirt 62, and the coupling 64 are formed of, for example, synthetic resin, cylindrical in shape, and linked with a water suction pipe 12. The coupling 64 is provided with a stopper 66 having the surface with protrusions and depressions such that the water intake is securely linked with the water suction pipe 12. A cavity 68 in the shape of a cylinder with the diameter larger than that for the coupling 64 is formed inside the main body 60, and a plurality of ridges 70 are formed on the inner wall thereof in such a way as protrudes towards the center of the main body 60. In this embodiment, four ridges are provided 90° apart around the inner wall; however, more than or less than four may be provided. A groove 72 is formed on the inner circumferential surface of the main body 60 between the main body 60 and the skirt 62, and a filter 74 is securely fitted in the groove 72 by a holding frame 76. The filter 74 prevents foreign matters contained in the bathtub 2 from being sucked in. In this embodiment, a net filter is illustrated; however, various other filters may be also used obviously. The skirt 62 cylindrical in shape has the underside open, forming a window for incoming water, and provided with a plurality of through-holes 78 formed on the circumferential wall thereof, serving as water passages. On the sidewall of the skirt 62, a protruding piece 80 made of the same synthetic resin as that making up the skirt 62 is formed with a through-groove 82, preventing the holding frame 76 from falling off.

With the water intake constructed as above, a sucking force of the pump 10 acting on the water intake 8 when water is sucked in is dispersed in various directions since the through-holes 78 formed in the skirt 62 are open in different directions while the skirt 62 is open downward. Consequently, even in the event the water intake 8 comes in contact with the body or the inner wall of a bathtub, sticking of the water intake 8 does not occur. Accordingly, clogging of the water intake 8 is prevented, avoiding stoppage in suction of water while a user does not feel discomfort due to sticking of the water intake 8 to the body.

Further, as foreign matter contained in the hot water 6 sucked into the water intake 8 is screened by the filter 74, these are neither sucked into the pump 10 nor injected into the body through the nozzle 14. The filter 74 can be removed together with the holding frame 76 by extending the protruding piece 80 towards the periphery of the skirt 62 so that the filter 74 is reusable after cleaning.

Figure 7:
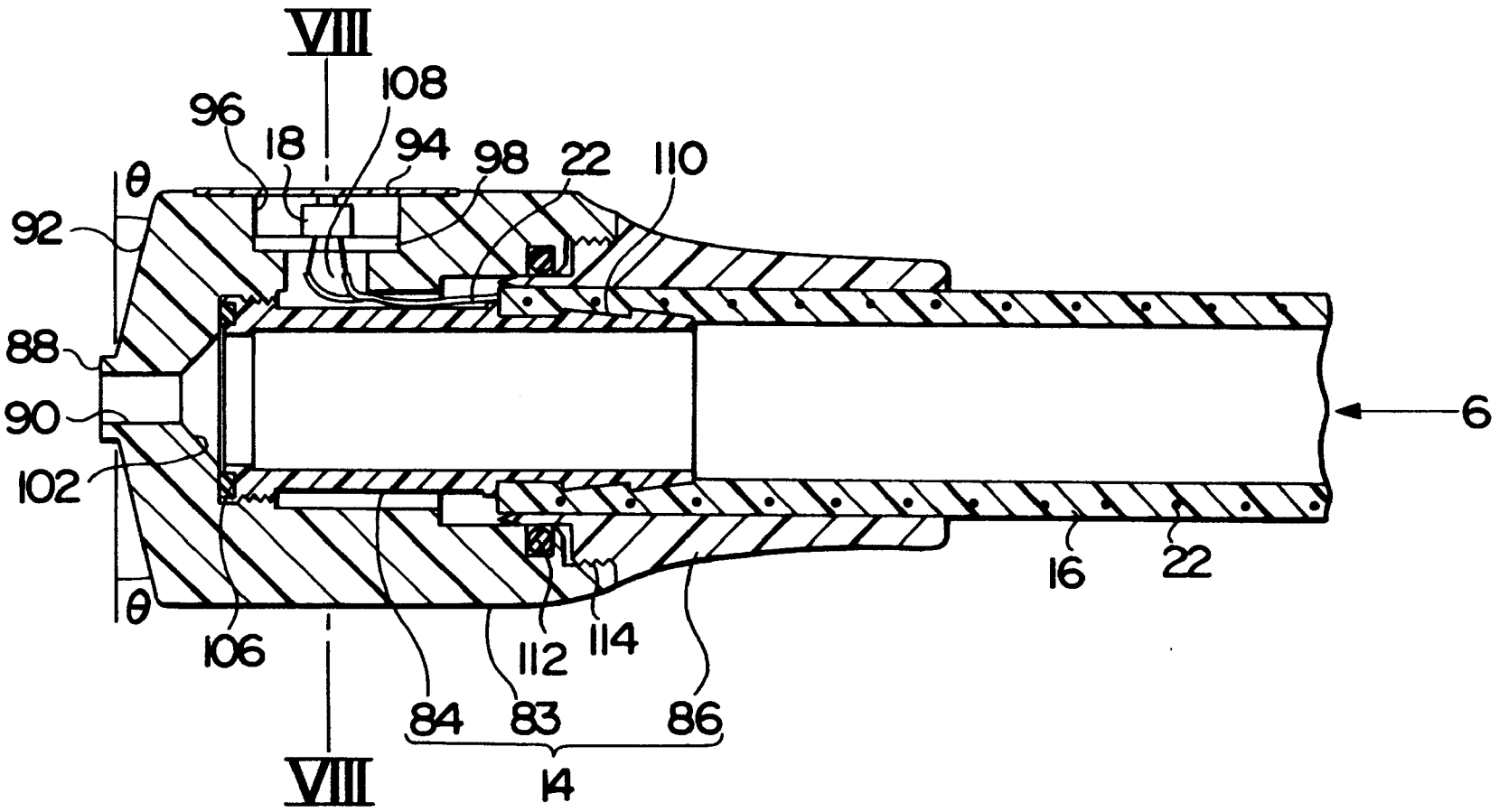
FIG. 7 is a longitudinal sectional view of a nozzle of the embodiment.
Figure 8:
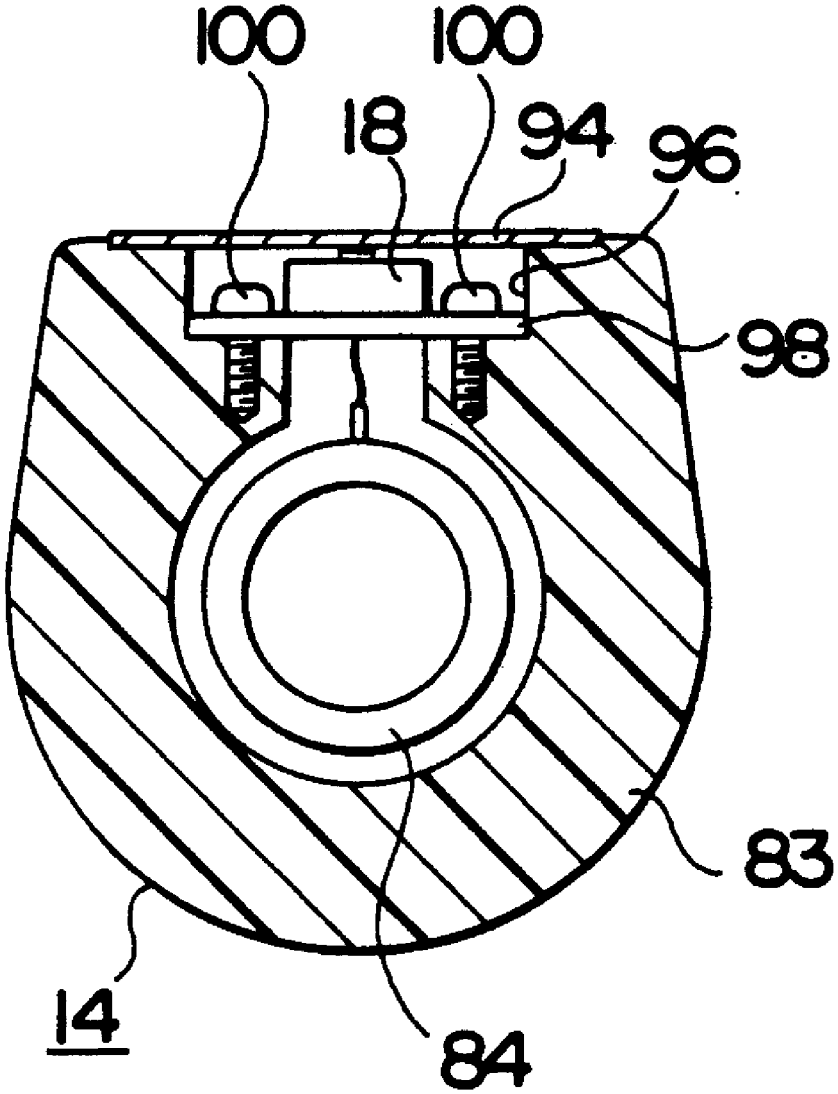
FIG. 8 is a transverse cross section of the nozzle taken on line VIII—VIII in FIG. 7.
Figure 9:
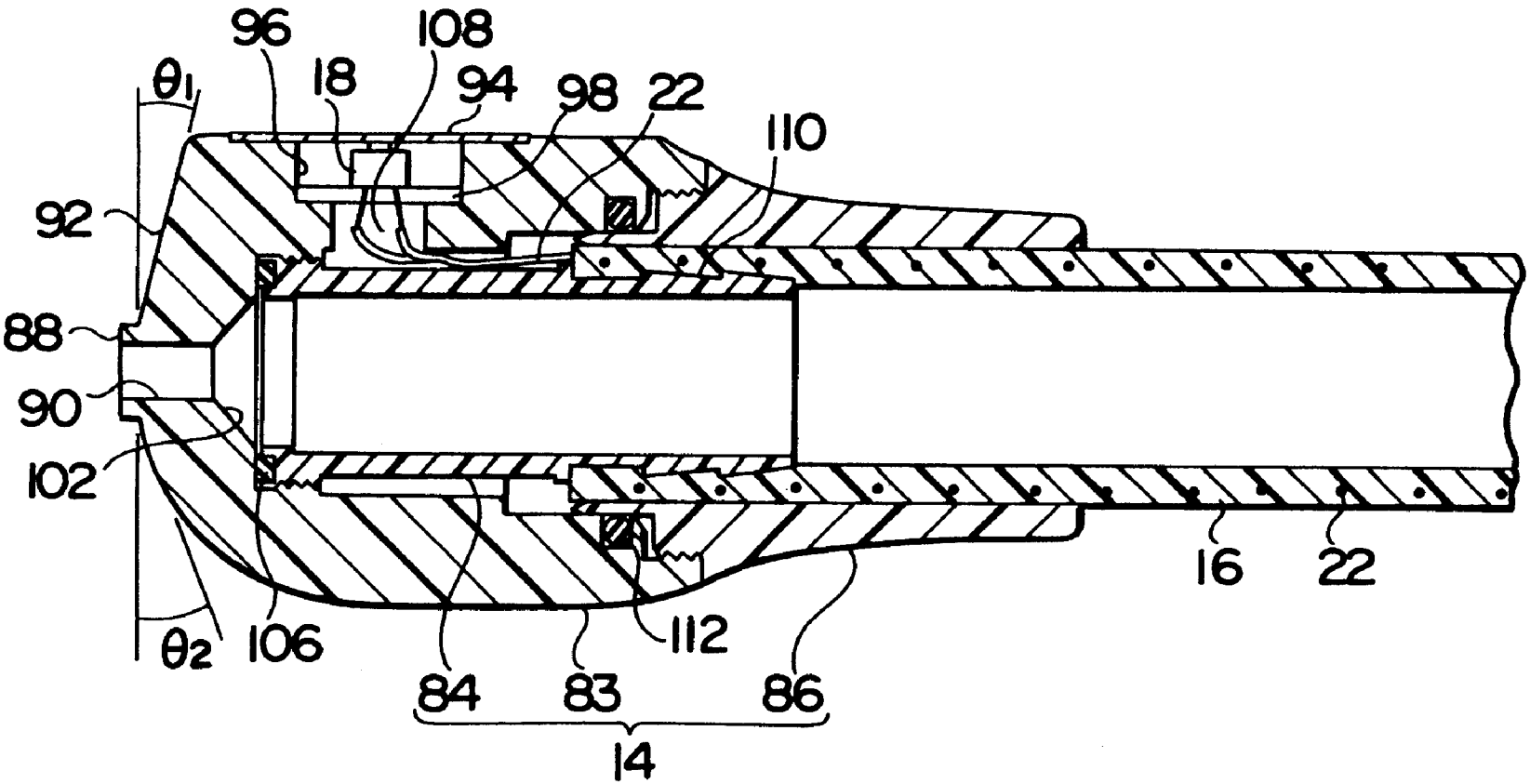
FIG. 9 is a longitudinal sectional view of another embodiment of the nozzle according to the invention.

FIGS. 7 to 9 show the construction of the nozzle specifically, and FIG. 8 is a transverse cross section of the nozzle taken on line VIII—VIII in FIG. 7.

The nozzle 14 comprises a main body 83, a water supply pipe joint 84, and a water supply pipe holder 86. The main body 83 is, for example, a molded synthetic resin, cylindrical in shape and of a size suitable to be held in one hand, and provided with a water supply port 88 on the wall at the front end thereof. The water supply port 88 is slightly projected from the surface at the tip of the main body 83, and provided with an orifice 90 for spouting water, circular in shape, therein. On the front end side of the main body 83, a tapered surface 92, receding from the external wall surface of the water supply port 88, and forming a tilt angle of 0 therewith, is provided. Further, a cavity 96 is formed in the external wall of the main body 83, and is closed by an elastic sheet cover 94. Inside the cavity 96, the startup switch 18 is installed. As shown in FIG. 8, the startup switch 18 together with a base board 98 are fixedly attached to the main body 83 by screws 100, and the startup switch 18 is connected with a cable 22 embedded in the water supply pipe 16.

Inside the main body 83, the orifice 90 for spouting water is formed into a bore section of expanding diameter 102 having an inclined wall surface, and linked with the front extremity of the water supply pipe joint 84 screwed onto the bore section of the expanding diameter 102 via a packing 106. A space 108, which is in watertight condition, is formed between the water supply pipe joint 84 and the main body 83, and the cable 22 is disposed in the space 108.

A stopper section 110 of the same diameter as that for the water supply pipe joint 84, and having the surface with protrusions and depressions formed thereon in a sectional view is formed at the rear end of the water supply pipe joint 84, and fitted into the water supply pipe 16. The water supply pipe holder 86 is fitted onto the periphery of the stopper 110, and securely held in watertight condition by fixing means, that is, a screw 114 with a packing 112 between the water supply pipe holder 86 and the main body 83.

With the system constructed as described above, the hot water 6 sucked in by the pump 10 and discharged via the water supply pipe 16 is led into the orifice 90 for spouting water, and due to a narrow sectional area of a passage for the hot water 6, a discharge pressure is amplified, producing a high water pressure and water jet. Manipulation of the nozzle 14 causes the water jet from the orifice 90 to beat at the surface of the body of a user.

The water supply pipe 16 has a small diameter for pressurization of the hot water being discharged, and linked with the nozzle 14 larger in diameter than the water supply pipe to allow the user to hold the nozzle with ease. The hot water 6 discharged under pressure through the water supply pipe 16 increases a discharge pressure thereof after flowing through a flow path of further narrowed cross sectional area inside the nozzle 14, and is spouted out of the orifice 90 as a water jet.

As the surface of the nozzle 14 from the main body 83 and the water supply pipe holder 86 towards the water supply pipe 16 is curved moderately, the nozzle 14 fits the user's palm with ease so that the user can cause water jet to beat at surface of the body freely while holding the nozzle with appropriate strength. The user can drive or stop the pump 10 quickly by manipulating the startup switch 18, and, for example, cause a water jet to beat at the surface of the body after determining a direction of water jet spouting from the nozzle 14, demonstrating excellent operability of the system.

As the nozzle 14 has the tapered surface 92 around the orifice 90 for injecting water, inclined at the tilt angle 0 in a receeding fashion, intervals between the front end surface of the nozzle 14 and the body are widened radially around the orifice 90. As a result, a velocity of water flow is decreased, and pressure of diffused water flows is diminished, preventing sticking of the nozzle 14 to the body.

Further, by varying the tilt angle, $\theta_1$, $\theta_2$, of the tapered surface 92 locally as shown in FIG. 9, where $\theta_1 \approx \theta_2$, a likelihood of the sticking phenomenon is further reduced. The tilt angle of the tapered surface may be set by not only a moderately inclined surface but also a surface with protrusions and depressions formed thereon.

Figure 10:
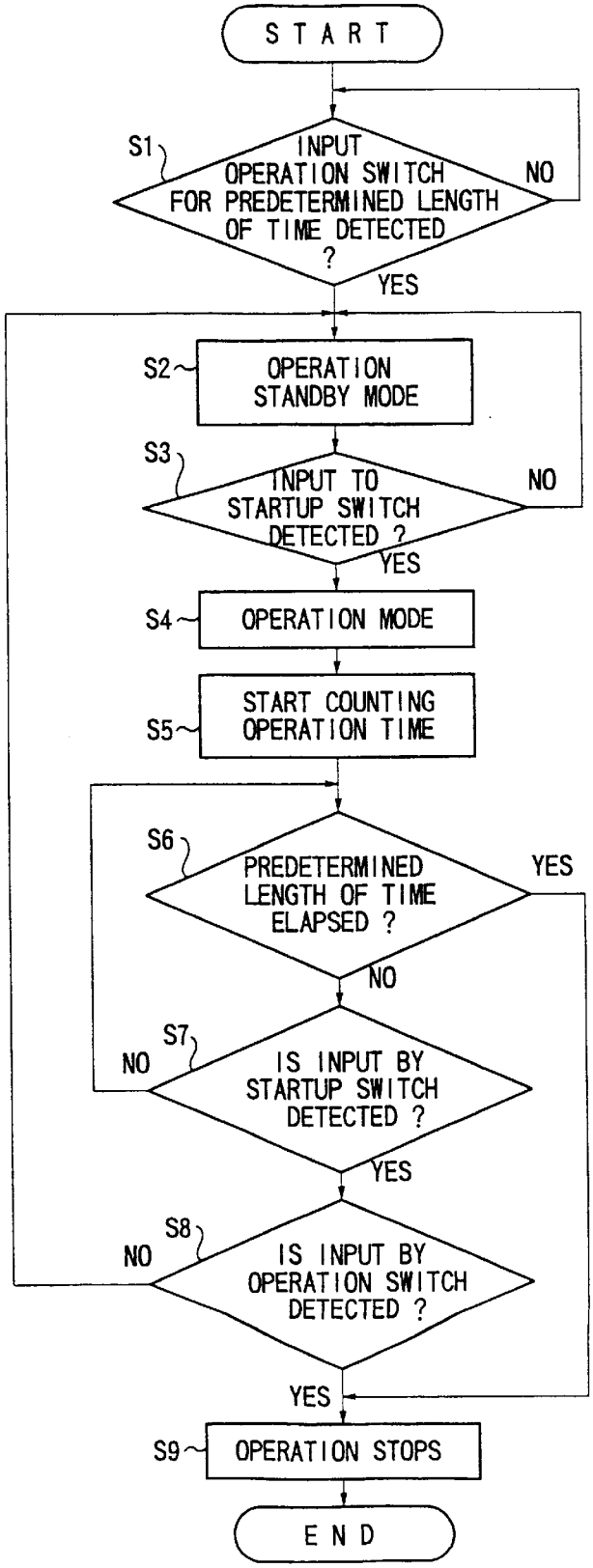
FIG. 10 a flow chart showing a mode of operation from start to suspension of the operation.
Figure 11:
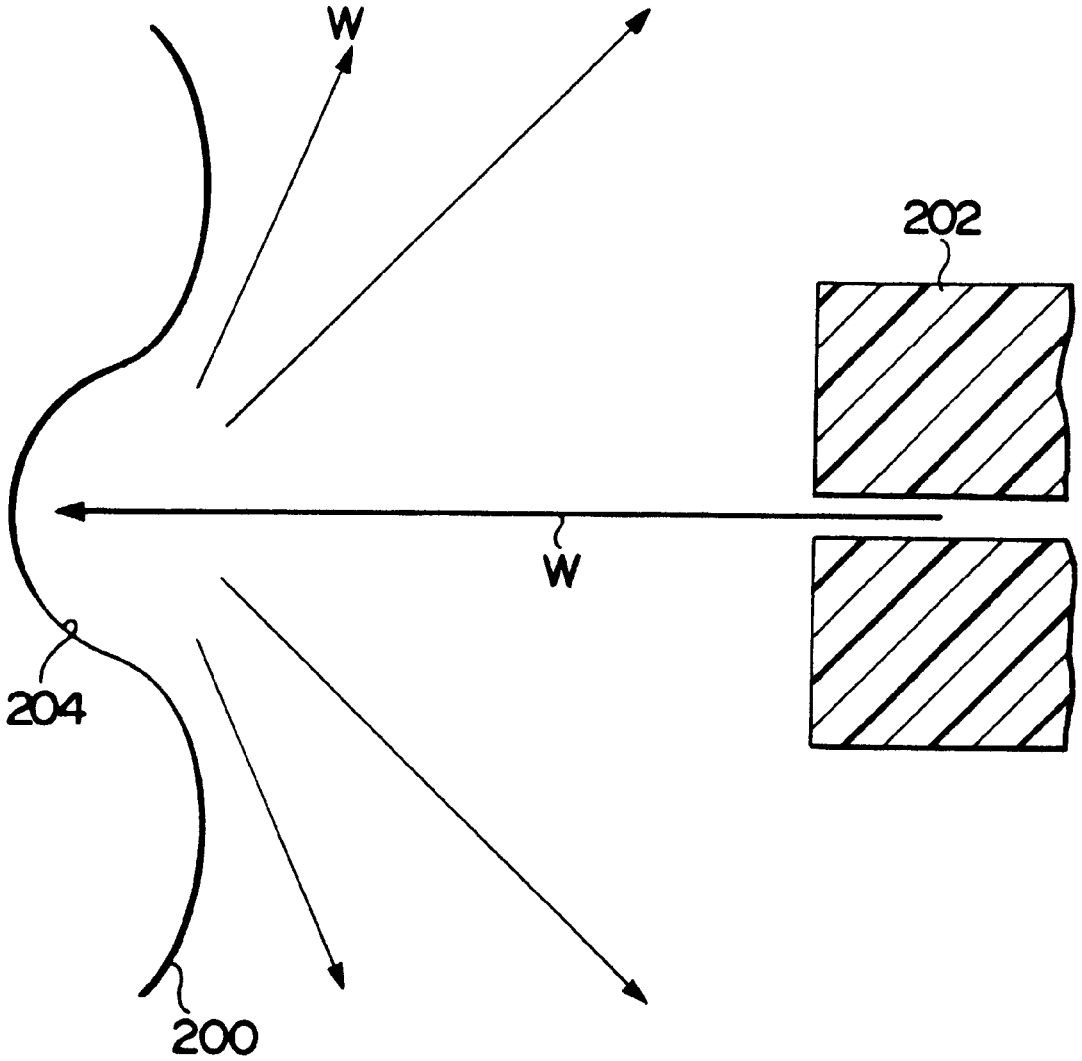
FIG. 11 PRIOR ART
FIG. 11 is a view illustrating a condition in which water jet is injected from the nozzle towards the body.
Figure 12:
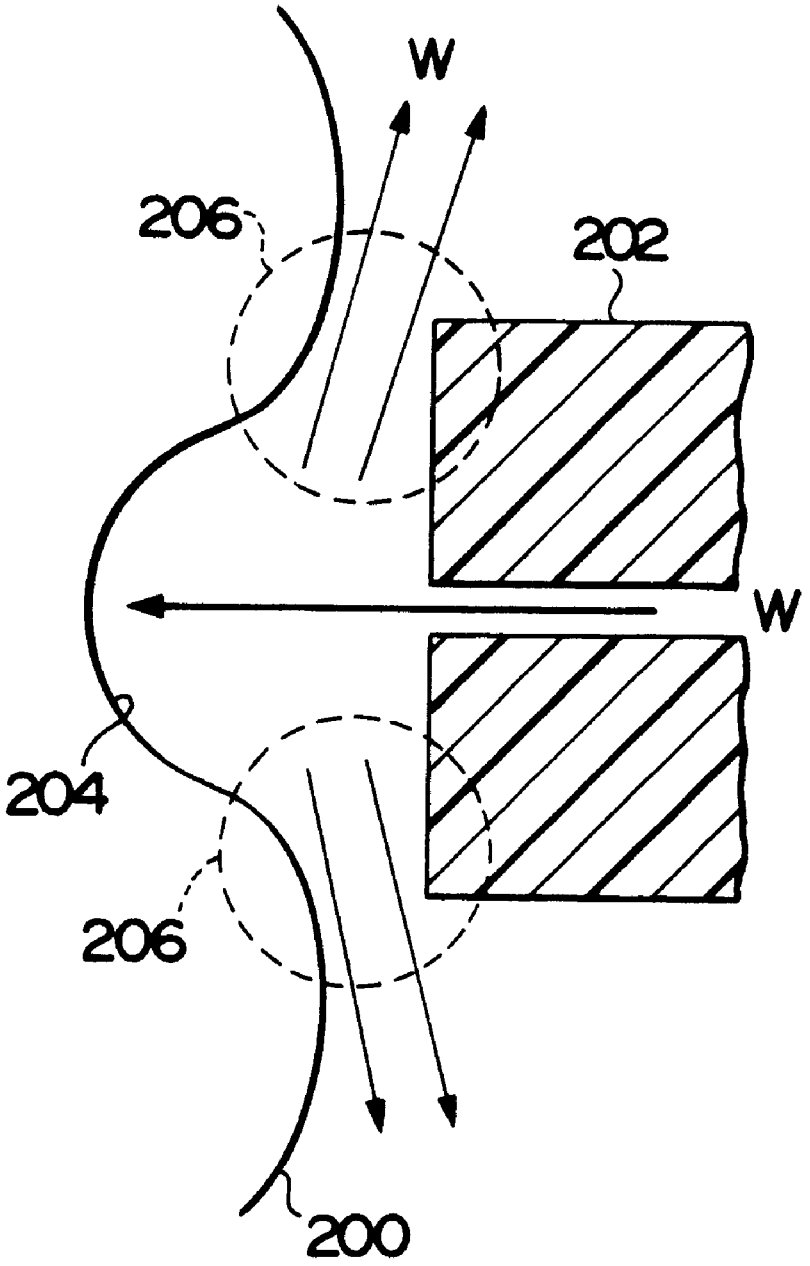
FIG. 12 PRIOR ART
FIG. 12 is a view illustrating a phenomenon of the nozzle sticking to the skin of a body.

Now, operation of the water jet massaging system according to the invention is described with reference to FIG. 10.

In step S 1, the CPU 46 performs sampling of the operation switch 26 via the switch input detection circuit 54, checking whether or not there has been input into the switch for a predetermined length of time in succession. In case that there has been no input into the switch in succession, monitoring of input into the switch is continued. In the affirmative case, the operation proceeds to a step S 2.

In step S 2, upon detection of input into the operation switch 26 for a predetermined length of time in succession, the CPU 46 proceeds to an operation standby mode, whereupon a condition restricting safety mechanism is released. In the operation standby mode, inadvertent touch on the switch does not cause spouting out of a water jet. Once in the operation standby mode, the CPU permits the pump 10 to be driven forthwith upon detection of input by the startup switch 18. Accordingly, the operation switch 26 functions as an emergency stop switch, and upon detection of a new input into the operation switch 26, the CPU 46 stops driving the pump 10, and release the operation from the operation standby mode, causing it to proceed to an OFF condition forcibly.

In step S 3, the CPU 46 performs sampling of input into the startup switch 18 in the operation standby mode via the switch input detection circuit 56, and decides whether or not input has been detected. In the affirmative case, the operation proceeds to a step S 4.

In step S 4, the operation shifts to an operation mode. In the operation mode, the relay contact 30 of the relay 28 is closed, driving the pump 10 by supplying an AC voltage thereto. Water is spouted out of the nozzle 14, enabling massaging by water jet.

In step S 5, upon shifting to the operation mode, the CPU 46 starts counting operating time of the pump 10. In step S 6, the CPU 46 checks whether or not a predetermined length of time has elapsed since start of operation of the pump 10. If not, the operation proceeds to a step S 7, and in the affirmative case, to a step S 9.

In the step S 7, the CPU 46 monitors input by the startup switch 18. Upon detection of input by the startup switch 18, the pump 10 is stopped, and the operation is shifted to the operation standby mode, proceeding to a step S 8. If not, the operation reverts to the step S6 while driving the pump 10.

In the step S 8, the CPU 46 checks whether or not input by the operation switch 26 has been detected. If not, the operation reverts to the step S 2, monitoring input by the startup switch 18. In case that input by the operation switch 26 is detected, the operation proceeds to the step S 9, releasing the operation standby mode, and the operation comes to a stop.

There are the following variations in embodying the invention.

a) In the foregoing embodiments, the water jet massaging system wherein the hot water 6 in the bathtub 2 is discharged by use of the pump 10 is described, however, water or hot water stored in a container other than the bathtub may also be sucked in therefrom and discharged through the nozzle.

b) Tap water may be spouted out of a nozzle provided in place of a shower nozzle, or tap water heated at a desired temperature by means of a hot water supply unit may be spouted out.

c) In the case that a supplementary water heater, whereby the hot water 6 is circulated around through the bathtub 2 and heated, is connected to the system, the hot water in the bathtub may be spouted out by a discharge pressure of a pump of the supplementary water heater by linking the nozzle 14 and the water supply pipe 16 to a connection port.

d) The water jet massaging system according to the invention may be used in combination with a supplementary water heater by actuating a hot water supply unit thereof.

As described hereinbefore, the invention can provide the following effects:

A. Water jet at an appropriate pressure can be injected by sucked in water from a water source, and the water jet is caused to beat at the surface of the body selectively by manipulating the nozzle with the result that excellent massaging effects due to pressurization and impact of the water jet can be provided by proper repetition of start, continuation, and release of operation.

B. Desired water jet can be produced using a bathtub or water supply as a water supply source.

C. Separation of the water intake from the body, the inner walls of a bathtub, or the like can be achieved by utilizing pressure therebetween, ensuring prevention of the water intake sticking and producing water jet continuously.

D. Radially widening intervals between the end face of the water intake and the body of a user ensures prevention of a sticking phenomenon due to water jet.

E. Start, continuation, and release of operation in driving the pump can be freely effected by controlling positioning of the nozzle together with manipulation of the switch provided in the nozzle, improving operability and enhancing massaging effects.

F. Operation of the pump can be stopped when a predetermined length of time elapses from the start of the operation through summation of operation time, enhancing safety and economics.

G. Prevention of the sticking phenomenon is further ensured by varying locally the tilt angle of the tapered surface on the front extremity of the nozzle, and further, by a design of the external geometry of the end face of the nozzle.

Although there has been described above the construction, operation, and effects of a preferred form of the invention, it will be appreciated that the water jet massaging system according to the invention is not limited thereto. Accordingly, any and all modifications, variations, equivalent arrangements which may occur to those skilled in the art should be considered to be within the scope of the invention.

What is claimed is:

1. A water jet massaging system for applying massage to a human body by spraying water thereagainst, and comprising:

a water source for supplying said water;

water jet generating means for generating a water jet and provided with a pump for sucking in said water from said water source through a water intake;

a nozzle linked with said water jet generating means for generating the water jet after passage through a flexible water supply pipe, and for spraying the water jet produced by said water jet generating means for generating a water jet;

a switch for turning operation of said pump on and off; and a control means for controlling operation of the pump on and off in response to switch actuation so that said water sucked in from said water source is sprayed onto the surface of the human body through said nozzle;

wherein said water intake is provided with a partition wall for partitioning a suction pressure of said pump, and passages for intake water flow are formed in spaced oppositely directed relation on the partition wall so that said water is sucked in from said water source through the passages.

2. A water jet massaging system for applying massage to a human body by propelling water thereagainst, and comprising:

a water source for supplying said water;

water jet generating means for generating a water jet and provided with a pump for sucking in said water from said water source through a water intake;

a nozzle linked with said water jet generating means for generating the water jet after passage through a flexible water supply pipe, and for injecting the water jet produced by said water jet generating means for generating a water jet;

a switch for turning operation of said pump on and off; and a control means for controlling operation of the pump on and off in response to switch actuation so that said water sucked in from said water source is injected to the surface of the human body through said nozzle;

wherein said nozzle is centrally located on a tapered front surface such that distances between said nozzle and the human body are increased radially.

3. A water jet massaging system for applying massage to a human body by propelling water thereagainst, and comprising:

a water source for supplying said water;

water jet generating means for generating a water jet and provided with a pump for sucking in said water from said water source through a water intake;

a nozzle linked with said water jet generating means for generating the water jet after passage through a flexible water supply pipe, and for injecting the water jet produced by said water jet generating means for generating a water jet;

a switch for turning operation of said pump on and off; and a control means for controlling operation of the pump on and off in response to switch actuation so that said water sucked in from said water source is injected to the surface of the human body through said nozzle;

wherein said switch is installed in a wall of said nozzle, and a signal line thereof is embedded in said water supply pipe for connection with said control means.

4. A water jet massaging system for applying massage to a human body by propelling water thereagainst, and comprising:

a water source for supplying said water;

water jet generating means for generating a water jet and provided with a pump for sucking in said water from said water source through a water intake;

a nozzle linked with said water jet generating means for generating the water jet after passage through a flexible water supply pipe, and for injecting the water jet produced by said water jet generating means for generating a water jet;

a switch for turning operation of said pump on and off; and a control means for controlling operation of the pump on and off in response to switch actuation so that said water sucked in from said water source is injected to the surface of the human body through said nozzle;

wherein said control means is capable of stopping operation of said pump when a predetermined length of time lapses after manipulation of said switch starts operation.

5. A water jet massaging system according to claim 2, wherein tilt angles of said tapered surface vary at different portions of the tapered surface.

6. A water jet massaging system according to claim 3 further comprising a bath for containing the water; and further wherein the water source is tap water.

7. A water jet massaging system according to claim 3 further comprising a bath for containing the water; and further wherein the water source is bath water to be recirculated.

8. A water jet massaging system comprising:

a water source for supplying water;

water jet generating means for generating a water jet and including— a) a pump creating suction at a water inlet thereof for suctioning water from the source through the pump;

b) a flexible water supply hose extending into the water;

c) a nozzle connected to an outlet end of the flexible hose for spraying a water jet;

switching means including a switch for turning pump operation on and off; and control means for controlling operation of the pump on and off in response to switch actuation so that said water sucked in from said water source is sprayed onto the surface of the human body through said nozzle;

wherein said control means is capable of stopping operation of said pump when a predetermined length of time lapses after manipulation of said switch starts operation.

9. The system set forth in claim 8 together with a bath for containing the water; and further wherein the water source is tap water.

10. The system set forth in claim 8 together with a bath for containing the water; and further wherein the water source is bath water to be recirculated.

11. The system set forth in claim 10 together with a water intake located in the bath and connected to the water inlet of the pump;

the water inlet provided with a partition wall for partitioning a suction pressure of said pump, and passages for intake water flow are formed in spaced oppositely directed relation on the partition wall so that said water is sucked in from said water source through the passages.

12. The system set forth in claim 8 wherein a control means for controlling operation of the pump on and off in response to switch actuation so that said water sucked in from said water source is sprayed to the surface of the human body through said nozzle; and wherein said nozzle is centrally located on a tapered front surface such that distances between said nozzle and the human body are increased radially.

13. The system set forth in claim 8 wherein the switching means includes a switch installed in a wall of the nozzle; and a signal line thereof embedded in the water hose for connection with a controlling circuit of the switching means.

14. The system set forth in claim 8 wherein said control means is capable of stopping operation of said pump when a predetermined length of time lapses after manipulation of said switch starts operation.

15. The system set forth in claim 12 wherein tilt angles of said tapered surface vary at different portions of the tapered surface.

* * * * *